US011305406B2

(12) United States Patent
Araki et al.

(10) Patent No.: US 11,305,406 B2
(45) Date of Patent: Apr. 19, 2022

(54) POWER TOOL HAVING HAMMER MECHANISM

(71) Applicant: MAKITA CORPORATION, Anjo (JP)

(72) Inventors: Yuta Araki, Anjo (JP); Hidenori Nagasaka, Anjo (JP); Manabu Sugimoto, Anjo (JP)

(73) Assignee: MAKITA CORPORATION, Anjo (JP)

( * ) Notice: Subject to any disclaimer, the term of this patent is extended or adjusted under 35 U.S.C. 154(b) by 60 days.

(21) Appl. No.: 16/793,302

(22) Filed: Feb. 18, 2020

(65) Prior Publication Data

US 2020/0262036 A1 Aug. 20, 2020

(30) Foreign Application Priority Data

Feb. 19, 2019 (JP) ..... JP2019-027699

(51) Int. Cl.
*B25B 21/02* (2006.01)
*B25D 16/00* (2006.01)

(52) U.S. Cl.
CPC ..... *B25B 21/026* (2013.01); *B25D 16/006* (2013.01); *B25D 2216/0084* (2013.01)

(58) Field of Classification Search
CPC ..... B25B 21/026; B25B 21/023; B25D 2216/0084; B25D 16/006; B25D 2211/064; B25D 2211/006; B23B 45/02; B23B 45/003; B25F 5/001; F16C 29/08; F16C 29/082; F16C 29/084; F16C 29/086
USPC ..... 173/205
See application file for complete search history.

(56) References Cited

U.S. PATENT DOCUMENTS 3,114,421 A 12/1963 McCloud
3,144,571 A 8/1964 Kukulski
3,429,356 A * 2/1969 Friedrich ..... F16C 29/08 160/223
3,736,992 A * 6/1973 Zander ..... B25D 16/00 173/48

(Continued)

FOREIGN PATENT DOCUMENTS

DE 102006044433 A1 4/2008
EP 1477282 A1 11/2004

(Continued)

*Primary Examiner* — Robert F Long
*Assistant Examiner* — Eduardo R Ferrero
(74) *Attorney, Agent, or Firm* — J-TEK Law PLLC; Jeffrey D. Tekanic; Scott T. Wakeman

(57) ABSTRACT

A power tool, such as a hammer driver-drill (1), includes a spindle (26) that is axially and rotatable supported inside a metal gear case (41). A first cam (83) is affixed to the spindle so as to rotate therewith and is housed in the gear case (41). A second cam (84) is disposed around spindle such that it is rotatable separately with respect to the spindle and can be brought into contact with the first cam. Hammer-switching levers (95) are movable relative to the gear case between an advanced position, at which rotation of the second cam is restricted (blocked), and a retracted position, at which the rotational restriction on the second cam is released. Receiving members (89) are respectively interposed between the gear case and the hammer-switching levers and are configured to absorb vibration generated when a hammering operation is being performed using the power tool.

19 Claims, 10 Drawing Sheets

(56) References Cited

U.S. PATENT DOCUMENTS 3,799,275 A * 3/1974 Plattenhardt ..... B25D 16/00 173/48
3,834,468 A * 9/1974 Hettich ..... B25D 16/006 173/48
4,202,096 A 5/1980 Nagashima
4,450,919 A 5/1984 Cousineau
4,567,950 A * 2/1986 Fushiya ..... B25D 16/006 173/104
4,638,562 A 1/1987 Drake
4,664,394 A 5/1987 Theissig et al.
4,667,749 A 5/1987 Keller
4,670,985 A 6/1987 Biersteker
4,743,124 A * 5/1988 Blaurock ..... F16C 29/0609 384/45
5,056,607 A * 10/1991 Sanders ..... B25D 16/006 173/48
5,343,961 A * 9/1994 Ichikawa ..... B25B 21/00 173/178
5,447,205 A * 9/1995 Thurler ..... B25D 16/00 173/13
5,451,127 A * 9/1995 Chung ..... B25D 16/006 173/47
5,458,206 A * 10/1995 Bourner ..... B25B 23/14 173/104
5,492,413 A * 2/1996 Tsukada ..... F16C 33/6622 384/15
5,494,115 A * 2/1996 Hwong ..... B25D 11/106 173/13
5,494,354 A * 2/1996 Tsukada ..... F16C 29/086 384/13
5,505,271 A * 4/1996 Bourner ..... B25D 16/00 173/205
5,531,278 A * 7/1996 Lin ..... B25D 16/00 173/13
5,624,195 A * 4/1997 Abe ..... F16C 29/063 384/15
5,692,574 A 12/1997 Terada
5,697,456 A 12/1997 Radle et al.
6,007,247 A * 12/1999 Rosengren ..... F15B 15/082 384/41
6,138,772 A * 10/2000 Miescher ..... B25D 16/00 173/109
6,142,242 A * 11/2000 Okumura ..... B25B 23/141 173/216
6,152,242 A * 11/2000 Chung ..... B25D 16/00 173/216
6,202,759 B1 * 3/2001 Chen ..... B25D 16/00 173/216
6,213,224 B1 4/2001 Furuta et al.
6,223,833 B1 * 5/2001 Thurler ..... B25D 16/00 173/109
6,510,614 B1 * 1/2003 Kato ..... F16C 29/0633 33/1 M
6,550,545 B1 * 4/2003 Manschitz ..... B25D 16/006 173/170
6,684,964 B2 * 2/2004 Ha ..... B25D 16/00 173/109
6,691,796 B1 * 2/2004 Wu ..... B25D 16/006 173/109
6,892,827 B2 * 5/2005 Toyama ..... B25D 16/003 173/178
6,966,773 B2 11/2005 Keller
7,051,820 B2 5/2006 Stirm
7,143,842 B2 12/2006 Ikuta
7,360,607 B2 * 4/2008 Aeberhard ..... B25B 23/141 173/176
7,735,575 B2 * 6/2010 Trautner ..... B25D 17/00 173/114
7,841,424 B2 * 11/2010 Chen ..... B25B 21/00 173/48
2001/0016089 A1 * 8/2001 Mochizuki ..... B23Q 1/58 384/45
2001/0037889 A1 11/2001 Kristen et al.
2002/0014140 A1 * 2/2002 Koch ..... F16C 29/082 82/137
2002/0125023 A1 9/2002 Hanke et al.
2003/0121679 A1 7/2003 Taga
2004/0194987 A1 10/2004 Hanke et al.
2004/0211576 A1 10/2004 Milbourne et al.
2005/0034882 A1 * 2/2005 Chen ..... B25D 16/006 173/48
2005/0157489 A1 7/2005 Oomori et al.
2005/0257945 A1 11/2005 Justis et al.
2005/0269117 A1 12/2005 Sato et al.
2006/0231277 A1 10/2006 Puzio et al.
2007/0044984 A1 3/2007 Fischer et al.
2007/0144310 A1 6/2007 Pozgay et al.
2007/0159812 A1 7/2007 Oomori et al.
2007/0209814 A1 9/2007 Furusawa et al.
2007/0261871 A1 11/2007 Ohlendorf
2007/0269148 A1 * 11/2007 Michioka ..... F16C 29/088 384/15
2007/0295522 A1 12/2007 Bohne et al.
2009/0049651 A1 2/2009 Roberts et al.
2009/0126958 A1 * 5/2009 Trautner ..... B25D 16/006 173/48
2009/0223691 A1 9/2009 Ikuta et al.
2009/0236110 A1 9/2009 Iwakami et al.
2009/0257692 A1 * 10/2009 Sattler ..... F16C 29/082 384/24
2009/0266571 A1 10/2009 Baumann et al.
2009/0314507 A1 12/2009 Iwakami
2009/0321101 A1 12/2009 Furusawa et al.
2010/0000748 A1 1/2010 Machida et al.
2010/0038105 A1 2/2010 Kikuchi et al.
2010/0051304 A1 3/2010 Aoki
2010/0095533 A1 4/2010 Takahashi et al.
2011/0011608 A1 1/2011 Saur
2011/0083868 A1 4/2011 Nishikimi et al.
2011/0088922 A1 4/2011 Hirayama et al.
2011/0100665 A1 5/2011 Nakashima
2011/0114347 A1 5/2011 Kasuya et al.
2011/0127055 A1 6/2011 Braun et al.
2011/0147031 A1 6/2011 Matthias et al.
2011/0168422 A1 7/2011 Fujiwara et al.
2011/0199756 A1 8/2011 Oomori et al.
2011/0203826 A1 8/2011 Hosokawa et al.
2011/0290517 A1 12/2011 Takeuchi et al.
2011/0297407 A1 12/2011 Sakai
2011/0303726 A1 12/2011 Blessing et al.
2011/0303733 A1 12/2011 Fielitz et al.
2011/0308828 A1 12/2011 Shinma et al.
2012/0031638 A1 2/2012 Kamegai et al.
2012/0033405 A1 2/2012 Oomori et al.
2012/0067605 A1 3/2012 Furusawa et al.
2012/0097410 A1 4/2012 Honsa
2012/0160533 A1 6/2012 Kamegai
2012/0255753 A1 10/2012 Kuhnle et al.
2012/0279740 A1 11/2012 Furusawa et al.
2012/0315103 A1 12/2012 Aoki
2012/0318551 A1 12/2012 Kuhnle et al.
2013/0043052 A1 2/2013 Harcar et al.
2013/0099722 A1 4/2013 Umemura et al.
2013/0153253 A1 6/2013 Ludy et al.
2013/0168121 A1 7/2013 Ullrich et al.
2013/0199810 A1 8/2013 Wyler
2014/0174777 A1 6/2014 Kakiuchi et al.
2015/0041170 A1 2/2015 Yoshikane et al.
2015/0093056 A1 * 4/2015 Liao ..... F16C 29/0609 384/44
2015/0174753 A1 6/2015 Kamiya
2015/0280517 A1 10/2015 Ekstrom et al.
2015/0328759 A1 11/2015 Ikuta et al.
2015/0345560 A1 * 12/2015 Roesch ..... F16C 33/6655 384/13
2015/0372633 A1 12/2015 Machida et al.
2016/0001433 A1 1/2016 Furusawa et al.
2016/0136801 A1 5/2016 Furusawa et al.
2016/0151905 A1 6/2016 Tada et al.
2017/0106517 A1 4/2017 Machida
2017/0106518 A1 4/2017 Takeuchi et al.

(56) References Cited

U.S. PATENT DOCUMENTS

| | | | |
|---|---|---|---|
| 2017/0194846 | A1 | 7/2017 | Tanimoto |
| 2017/0312902 | A1 | 11/2017 | Noguchi et al. |
| 2018/0099393 | A1 | 4/2018 | Iida et al. |
| 2018/0099396 | A1 | 4/2018 | Iida et al. |

FOREIGN PATENT DOCUMENTS

| | | | |
|---|---|---|---|
| EP | 2468455 | A1 | 6/2012 |
| FR | 2488179 | A1 | 2/1982 |
| GB | 2154497 | A | 9/1985 |
| JP | S55151482 | U | 10/1980 |
| JP | S5976218 | A | 5/1984 |
| JP | S6181888 | U | 5/1986 |
| JP | 2005219195 | A | 8/2005 |
| JP | 2007196337 | A | 8/2007 |
| JP | 2010144921 | A | 7/2010 |
| JP | 2014024126 | A | 2/2014 |
| JP | 2014124697 | A | 7/2014 |
| JP | 2014124698 | A | 7/2014 |
| JP | 2014133284 | A | 7/2014 |
| JP | 2016022567 | A | 2/2016 |
| JP | 2019000936 | A | 1/2019 |
| WO | 2008034668 | A1 | 3/2008 |
| WO | 2015145583 | A1 | 10/2015 |
| WO | 2015190355 | A1 | 12/2015 |

* cited by examiner

POWER TOOL HAVING HAMMER MECHANISM

CROSS-REFERENCE

The present application claims priority to Japanese patent application serial number 2019-027699 filed on Feb. 19, 2019, the contents of which are incorporated fully herein by reference.

TECHNICAL FIELD

The present invention generally relates to a power tool having a hammer mechanism, such as a hammer driver-drill comprising a hammer mechanism that is selectively usable in a hammer mode of the hammer driver-drill.

BACKGROUND ART

In known hammer driver-drills and similar power tools having a hammer mechanism, rotation of a motor, which is housed inside a housing, is transmittable to a spindle, which constitutes an output shaft, via a speed-reducing mechanism. The hammer mechanism is operably disposed between the speed-reducing mechanism and the spindle such that it is capable of imparting hammering (repetitive impacts) to the spindle in an axial direction. The power tool is configured to make it possible to select either a hammer mode, in which axial hammering is imparted to the spindle while it rotates, and a drilling mode, in which hammering is not imparted while the spindle rotates, e.g., by rotating an action-mode changing ring mounted on the exterior of the housing.

In U.S. Pat. No. 6,213,224, the spindle is axially supported by a tubular part provided on a gear housing (a case), which is made of metal and is held by the housing. In this power tool, the hammer mechanism is disposed inside the tubular part, and the hammer mode is actuated (selected) by sliding a hammer-switching member into the tubular part.

SUMMARY OF THE INVENTION

In the power tool of U.S. Pat. No. 6,213,224, there is a risk that the hammer-switching member will experience microvibrations inside the tubular part when used in the hammer mode. As a result thereof, the tubular part, which holds the hammer-switching member, may wear out prematurely.

Accordingly, it is one, non-limiting object of the present teachings to disclose a power tool having a hammer mechanism that can reduce or minimize wear of a case made of metal, thereby improving durability.

In a first aspect of the present teachings, a power tool comprises: a case made of metal; a spindle axially supported inside the case; a first cam, at least a portion of which is housed in the case and which is fixed to the spindle such that it is rotatable integrally therewith; a second cam, at least a portion of which is housed in the case, is rotatable separately with respect to the spindle and is provided such that it is capable of contacting (can be brought into contact with) the first cam; a switching member, which is provided such that it is moveable, relative to the case, between a first position, at which rotation of the second cam is restricted (blocked), and a second position, at which the rotational restriction of the second cam is released; and a receiving member interposed between the case and the switching member. Preferably, the receiving member holds or supports the switching member so that it is moveable, e.g., axially slidable, relative to the receiving member. Optionally, the receiving member is a resin (polymer) member.

In another aspect of the present teachings, a slit is formed in the case and the receiving member mates with (is fitted in) the interior of the slit, preferably so that the receiving member does not move relative to the slit during operation. The receiving member holds the switching member such that the switching member is movable, e.g., slidable, within the receiving member.

In another aspect of the present teachings, a plurality of the switching members is provided, and a corresponding number of receiving members are provided, such that the switching members are respectively received (held) in the receiving members. The receiving members are integrally coupled to one another, e.g., via a spacer.

In another aspect of the present teachings, the receiving member(s) is (are) made of resin (polymer).

In another aspect of the present teachings, a power tool comprises: a case made of metal; a spindle axially supported inside the case; a first cam, at least a portion of which is housed in the case and which is fixed to the spindle such that it is rotatable integrally therewith; a second cam, at least a portion of which is housed in the case and which is provided on the spindle such that it is rotatable separately therefrom and provided such that it is capable of contacting (can be brought into contact with) the first cam; a switching member, which is provided such that it is moveable, e.g., slidable, relative to the case, between a first position, at which rotation of the second cam is restricted (blocked), and a second position, at which the rotational restriction of the second cam is released; and a resin (polymer) member interposed between the case and the switching member. Preferably, the resin (polymer) member holds or supports the switching member so that it is moveable, e.g., axially slidable, relative to the resin (polymer) member.

In another aspect of the present teachings, the resin (polymer) member is fixed to an inner side of the case and guides movement, e.g. sliding, of the switching member relative to the case.

Thus, in one or more aspects of the present teachings, wear of a case made of metal can be reduced, thereby improving durability. Additional objects, aspects, embodiments and advantages of the present teachings will become apparent upon reading the following detailed description of embodiments of the present teachings in conjunction with the appended Figures and claims.

BRIEF DESCRIPTION OF THE DRAWINGS

FIGS. 8A-8D are explanatory diagrams of the spacer, wherein FIG. 8A is a front view thereof, FIG. 8B is a plan view thereof, FIG. 8C is a rear view thereof, and FIG. 8D is a side view thereof.

FIGS. 9A and 9B are center, longitudinal, cross-sectional views of the gear assembly, wherein FIG. 9A shows the gear assembly in a hammer mode, and FIG. 9B shows the gear assembly in a drilling mode (i.e. the hammer mechanism is de-activated).

DETAILED DESCRIPTION OF THE PREFERRED EMBODIMENTS

Embodiments of the present teachings will be explained below, with reference to the drawings.

Figure 1:
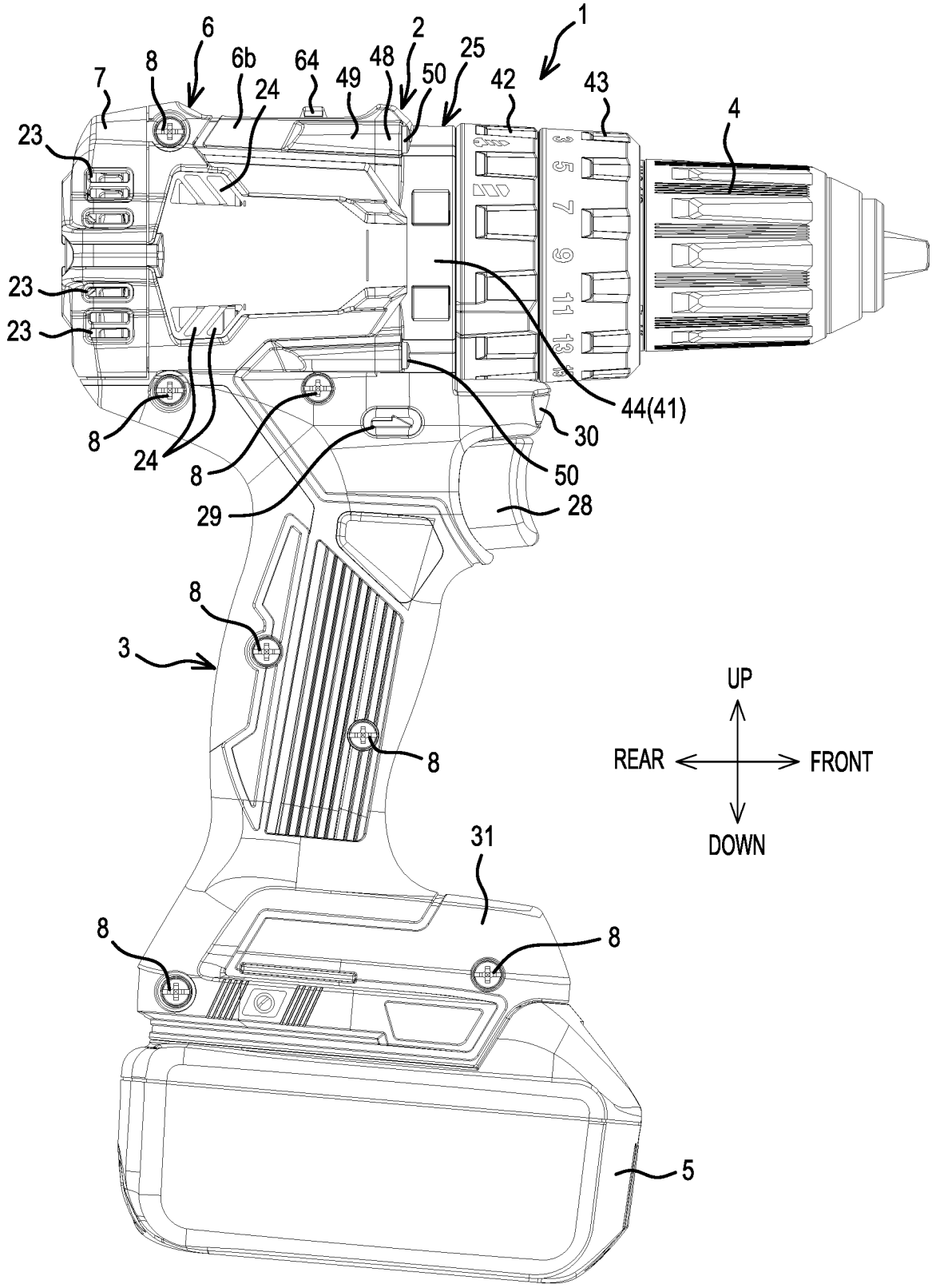
FIG. 1 is a side view of a hammer driver-drill according to one non-limiting embodiment of the present teachings.
Figure 2:
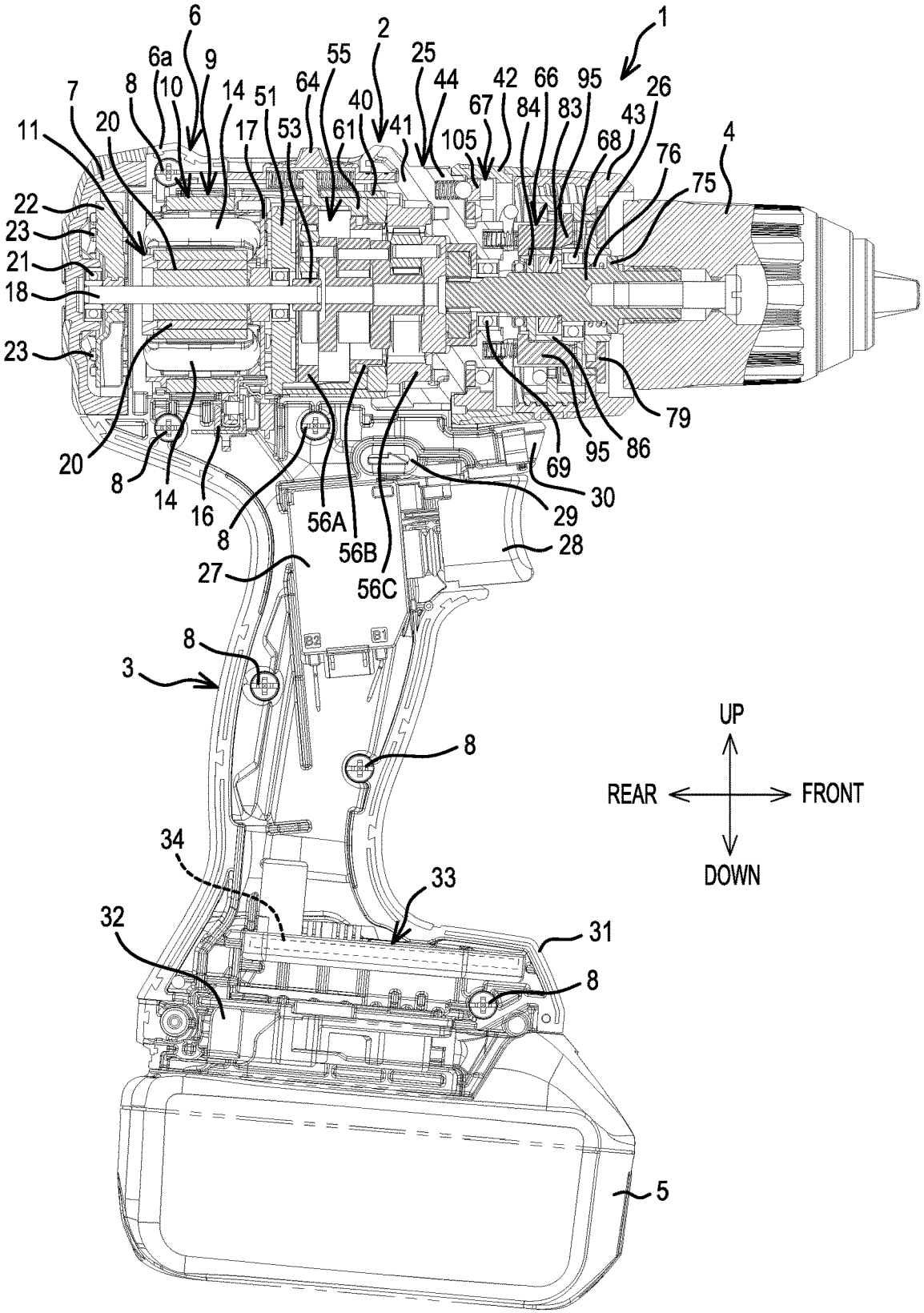
FIG. 2 is a center, longitudinal, cross-sectional view of the hammer driver-drill.

FIG. 1 is a side view of a hammer driver-drill 1 and shows one example of a power tool having a hammer mechanism according to the present teachings. FIG. 2 is a center, longitudinal, cross-sectional view thereof.

The hammer driver-drill 1 has a T shape in side view, in which a handle 3 protrudes from a lower side of a main body 2 that extends in a front-rear direction. A drill chuck 4 configured to grip (hold) a tool bit (tool accessory) at its tip is provided on (at) a front end of the main body 2. A battery pack (battery cartridge) 5 constituting a power supply is mounted on a lower end of the handle 3. A tubular rear-half portion of the main body 2 and the handle 3 are contiguously provided to form a main-body housing 6. More specifically, the main-body housing 6 is formed by assembling (joining) left and right half housings 6*a*, 6*b* together using screws 8 that extend in the left-right direction of the hammer driver-drill 1. A cap-shaped rear cover 7 is assembled (attached) onto a rear part of the main-body housing 6 using one or more screws (not shown).

Figure 3:
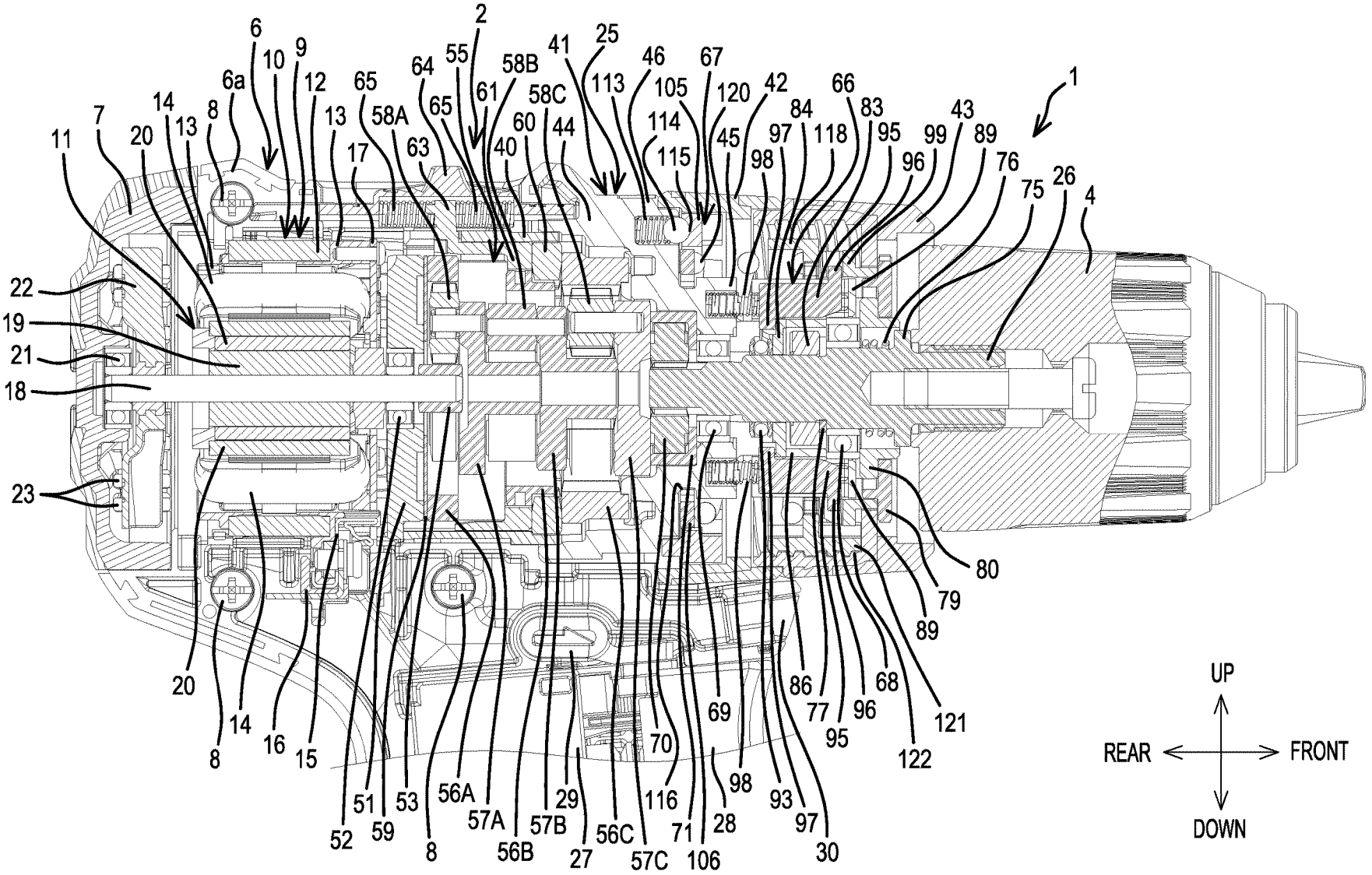
FIG. 3 is an enlarged view of a main-body portion shown in FIG. 2.

As shown in FIG. 3, an inner-rotor type brushless motor 9, which comprises a stator 10 and a rotor 11 that passes through the stator 10, is housed inside the main body 2 in a rear part thereof. A plurality of coils 14 is wound, around front and rear insulators 13, on a stator core 12 of the stator 12. The stator core 12 is formed by a plurality of layers of steel sheets. The stator 10 is held, in the front-rear direction, coaxially in the tubular portion of the main body 2 by ribs provided inside the main-body housing 6. Terminal fittings (fusing terminals) 15, which form a three-phase connection by being respectively fused to one or more coils 14 of each of the three phases, are provided on the front-side insulator 13 and protrude downward of the stator 10. A terminal unit 16, which is connected to lead wires that are connected to the controller 33, is screw-fastened to the terminal fittings 15 and is thereby electrically connected to the controller 33. In addition, a sensor-circuit board 17, on which rotation-detection devices (e.g., Hall ICs) that detect the magnetic fields of permanent magnets 20 provided on the rotor 11 are installed, is mounted on the front-side insulator 13.

With regard to the rotor 11, the permanent magnets 20 are embedded in a rotor core 19, which has a rotary shaft 18 at its axial center. A rear end of the rotary shaft 18 is axially supported by a bearing 21, which is provided on the rear cover 7, and a fan 22 is fastened to the rotary shaft 18 forward thereof. Air-exhaust ports 23 are formed in an outer circumference of the rear cover 7, and air-suction ports 24 (see FIG. 1) are formed in the left and right of the main body 2 radially outward of the stator 10.

A gear assembly 25, which comprises a spindle 26 that protrudes forward from the main-body housing 6, is assembled forward of the brushless motor 9; thereby, the rotational speed of the rotary shaft 18 can be reduced and transmitted to the spindle 26. The drill chuck 4 is attached to a front end of the spindle 26. A switch 27, from which a trigger 28 protrudes forward, is housed in an upper part of the handle 3 downward of the gear assembly 25. A forward/reverse-switching button (reversing switch lever or reversing switch) 29 for switching (changing) the rotating direction (forward/reverse) of the brushless motor 9 is provided upward of the switch 27. Forward thereof, a light 30 comprising at least one LED that illuminates forward of the drill chuck 4 is housed in a diagonally upward orientation.

On the lower side of the main-body housing 6, a battery-mount part 31, on which the battery pack 5 is mounted by sliding from the front, is formed on a lower end of the handle 3. The battery-mount part 31 houses (holds) both a terminal block 32, to which the battery pack 5 is electrically connected, and the controller 33, which comprises a control circuit board 34 on which a microcontroller for controlling the brushless motor 9, a switching device, and the like are installed. The controller 33 is disposed above the terminal block 32 and is electrically connected thereto.

Figure 4:
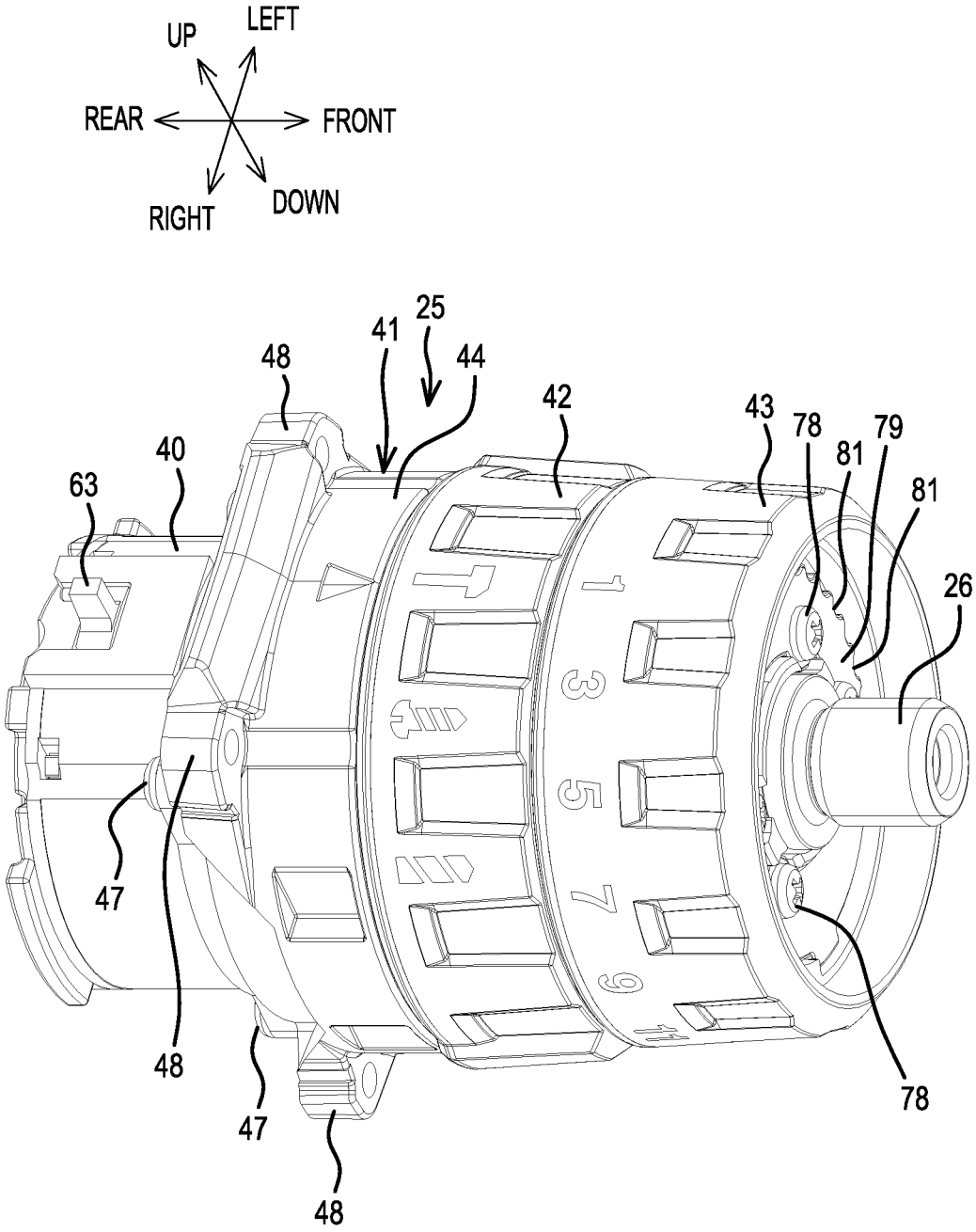
FIG. 4 is an oblique view of a gear assembly of the hammer-drive drill.
Figure 5B:
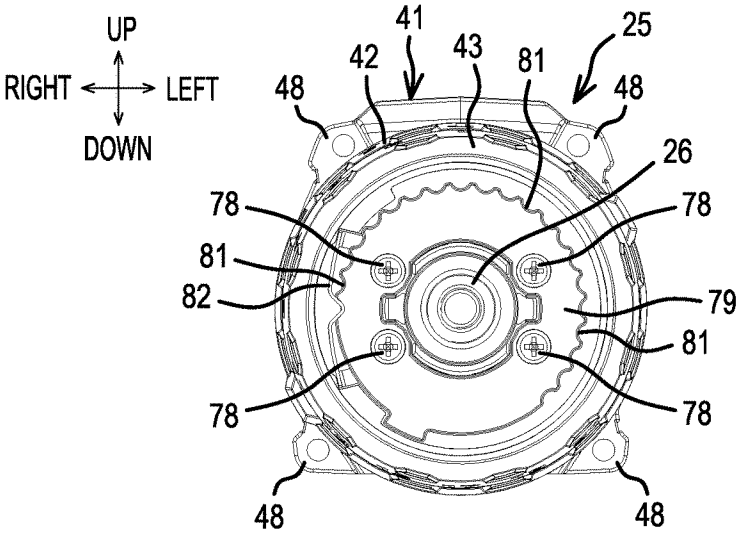
FIG. 5B is a front view thereof.
Figure 5A:
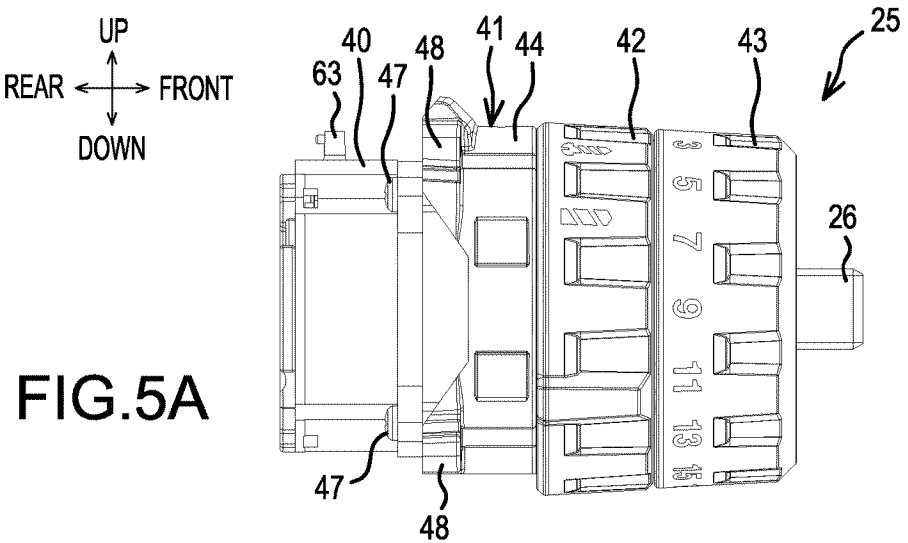
FIG. 5A is a side view of the gear assembly.
Figure 5C:
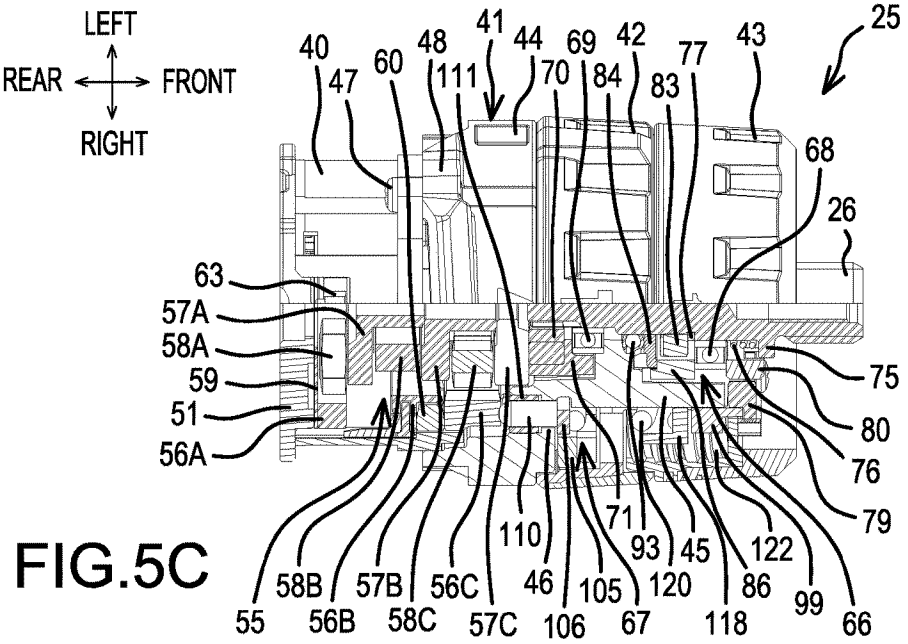
FIG. 5C is a half-section view thereof, as viewed from above.
Figure 6:
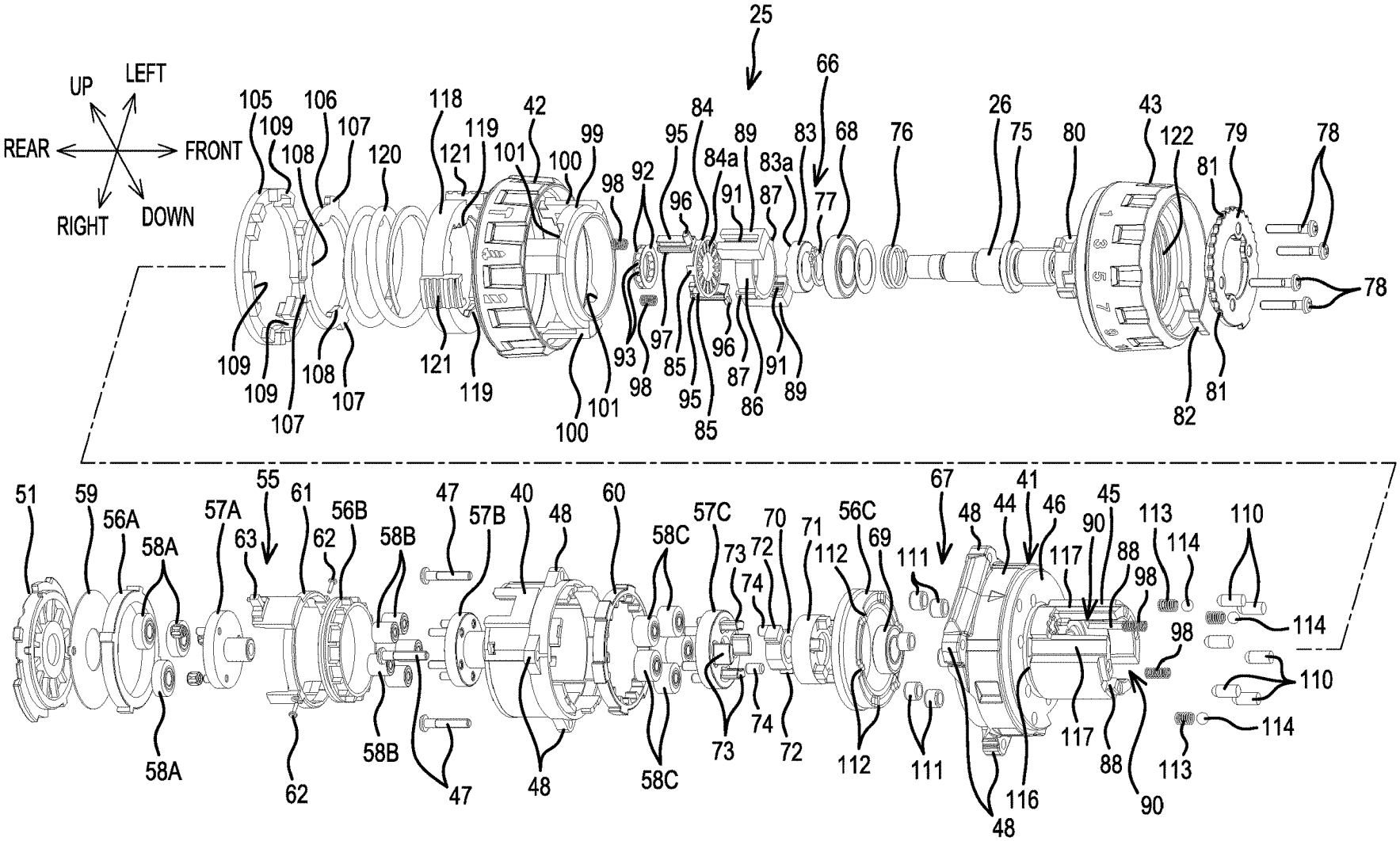
FIG. 6 is an exploded oblique view of the gear assembly.

As shown in FIGS. 4-6, the gear assembly 25 comprises: a tubular first gear case 40; a tubular second gear case 41, which is assembled onto a front side of the first gear case 40; and an action-mode changing ring 42 and a clutch ring (adjusting ring) 43, which are assembled onto a front side of the second gear case 41. The first gear case 40 is made of resin (polymer), whereas the second gear case 41 is made of aluminum or an aluminum alloy, i.e. a metal. The second gear case 41 has a two-stepped tubular shape and comprises a disk part 46 that connects a large-diameter portion 44 on its rear side and a small-diameter portion 45 on its front side together. The first gear case 40 is coupled to rear side of the large-diameter portion 44 by one or more screws 47.

The gear assembly 25 is fixed (joined) to the main-body housing 6 by four screws 50 (see also FIG. 1) that respectively pass through four screw-fastening parts 48, which are provided on the outer circumference of the second gear case 41, into four screw bosses 49, which are provided on the outer circumference of the main-body housing 6. In this joined state, a front end of the rotary shaft 18 passes through a bracket plate 51, which closes up a rear end of the first gear case 40 and is supported via a bearing 52. A pinion 53 is provided on the front end of the rotary shaft 18.

As can be seen in particular in the exploded view of FIG. 6, a speed-reducing mechanism 55 includes three stages of carriers 57A-57C, which support a plurality of (three) sets of planet gears 58A-58C that respectively revolve inside internal gears 56A-56C. The three sets of planet gears 58A-58C are disposed in an axial direction. The speed-reducing mechanism 55 is housed in the interior of the gear assembly 25, and the pinion 53 of the rotary shaft 18 meshes with the first-stage set of planet gears 58A. The first-stage internal gear 56A meshes with the first-stage planet gears 58A and is positioned by the bracket plate 51 via a washer 59.

In addition, the second-stage internal gear 56B is both rotatable and capable of forward-rearward movement in the axial direction. This second-stage internal gear 56B is configured to mesh with a coupling ring 60, which is held inside the large-diameter portion 44, when it is moved to an advanced position.

Referring now to FIGS. 3 and 6, a speed-changing ring 61, which is capable of forward-rearward movement in the state in which rotation is restricted within the first gear case 40, is externally mounted on a rear-half portion of the second-stage internal gear 56B and is integrally coupled thereto in the front-rear direction by coupling pins 62. A coupling piece 63, which protrudes upward from the speed-changing ring 61, is coupled, via front and rear coil springs 65, to a speed change lever 64, which is provided on an upper surface of the main-body housing 6 such that it is capable of sliding forward and rearward.

When the speed change lever 64 is slid rearward, the speed-changing ring 61 retreats (moves rearward) via the coupling piece 63, and the second-stage internal gear 56B integral therewith meshes with an outer circumference of the first-stage carrier 57A while maintaining the meshing with the second-stage set of planet gears 58B. In this rearward (retreated) position of the speed-changing ring 61, a high-speed (low-torque) mode results wherein the second-stage deceleration is cancelled (deactivated). Conversely, when the speed change lever 64 is slid forward, the second-stage internal gear 56B, together with the speed-changing ring 61, also advances, separating from the carrier 57A, and meshes with the coupling ring 60 while maintaining the meshing with the second-stage set of planet gears 58B, and thereby rotation is restricted. In this forward (advanced) position of the speed-changing ring 61, a low-speed (high-torque) mode results wherein the second-stage deceleration functions.

Furthermore, a hammer mechanism 66, which imparts hammering (axial impacts) to the spindle 26 in the axial direction, and a clutch mechanism 67, which shuts off (interrupts, disengages) the transmission of torque to the spindle 26 at a prescribed load on the spindle 26, are provided on the gear assembly 25. That is, by rotating the action-mode changing ring 42 (as will be further discussed below), it is possible to select an operating (action) mode from among: (i) a hammer drilling mode (rotation with hammering), in which the spindle 26 is hammered (repeatedly struck) in the axial direction while the spindle 26 rotates; a drilling mode, in which the spindle 26 only rotates; and a screwdriving mode (rotation with clutch; also known as a "clutch mode"), which shuts off (interrupts) the transmission of torque from the gear assembly 25 to the spindle 26 at a prescribed load. Each of these mechanisms is further explained below.

First, it is noted that the spindle 26 is axially supported by front and rear bearings 68, 69 inside of the small-diameter portion 45 of the second gear case 41. A rear end of the spindle 26 is slidably coupled to a lock cam 70 integrally with the third-stage carrier 57C in the rotational direction and is capable of forward-rearward movement in the axial direction. The lock cam 70 is rotatably provided inside a tubular lock ring 71, which is located on the outer side thereof and whose rotation inside the small-diameter portion 45 is restricted (blocked). Rotation of the carrier 57C is transmitted to the lock cam 70 by the engagement of a pair of engagement parts 72 on the lock cam 70 with a pair of tabs 73, which protrude from a front surface of the third-stage carrier 57C. Furthermore, it is configured such that, when turning the drill chuck 4 to mount or dismount the tool bit (while the brushless motor 9 is stopped), rotation of the spindle 26 is locked by virtue of wedge pins 74, 74, which are provided between the tabs 73, biting in between the lock ring 71 and a bevel (chamfered) portion of the lock cam 70.

In the hammer mechanism 66, a coil spring 76 is mounted around the spindle 26 between a flange 75, which is formed on the spindle 26 slightly forward of the coil spring 76, and the front side of the bearing 68. The spindle 26 is biased by the coil spring 76 toward the advanced position at which a retaining ring 77 makes contact with the bearing 68. The coil spring 76 is mounted around the spindle 26 to normally bias the spindle 26 toward frontward. A discoidal (disk-shaped) retaining plate 79 is fixed, by four screws 78, onto a front surface of the small-diameter portion 45 and positions the bearing 68 between a stopper 80, which mates with the retaining plate 79, and the retaining ring 77. The retaining plate 79 makes contact with the front surface of the clutch ring (adjusting ring) 43 and also prevents the action-mode changing ring 42 and the clutch ring 43 from slipping off. Recesses 81 are formed at regular intervals on the outer circumference of the retaining plate 79. A leaf spring 82, which is configured to elastically latch in one of recesses 81 (depending on the rotational position of the retaining plate 79 relative to the clutch ring 43 (see FIG. 5B)), is fixed onto a front-end inner surface of the clutch ring 43.

In addition, a ring-shaped first cam 83 and a ring-shaped second cam 84 are coaxially mounted around the spindle 26 between the bearings 68, 69. The first cam 83 has, on its rear surface, a first cam surface 83*a* composed of a plurality of axially-rearward-extending teeth, and is fastened (fixed) to the spindle 26 rearward of the retaining ring 77. The second cam 84 has, on its front surface, a second cam surface 84*a* composed of a plurality of axially-forward-extending teeth, and is loosely disposed on the spindle 26. Six meshing projections 85 project rearward from a rear surface of the outer circumference of the second cam 84 and are disposed equispaced around the circumferential direction of the second cam 84.

Figure 9A:
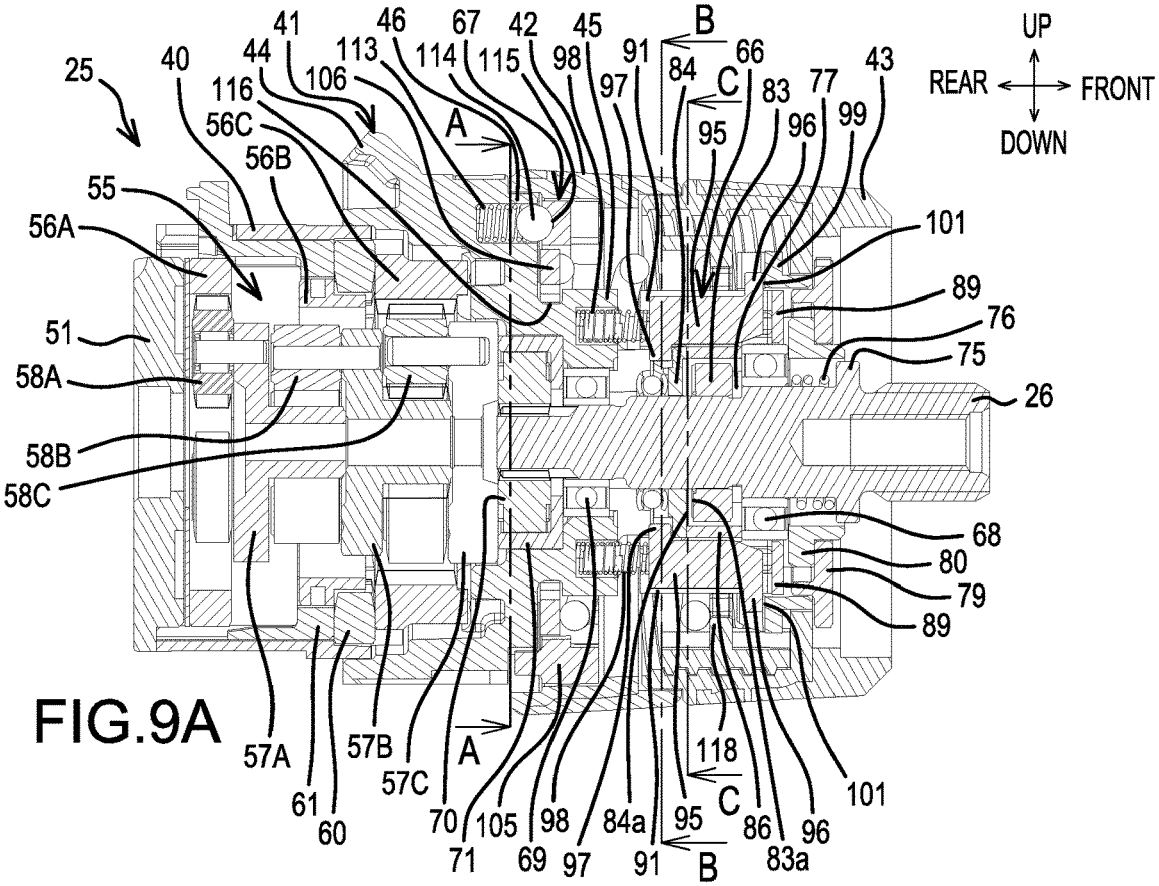
Figures 10A, 10B, 10C:
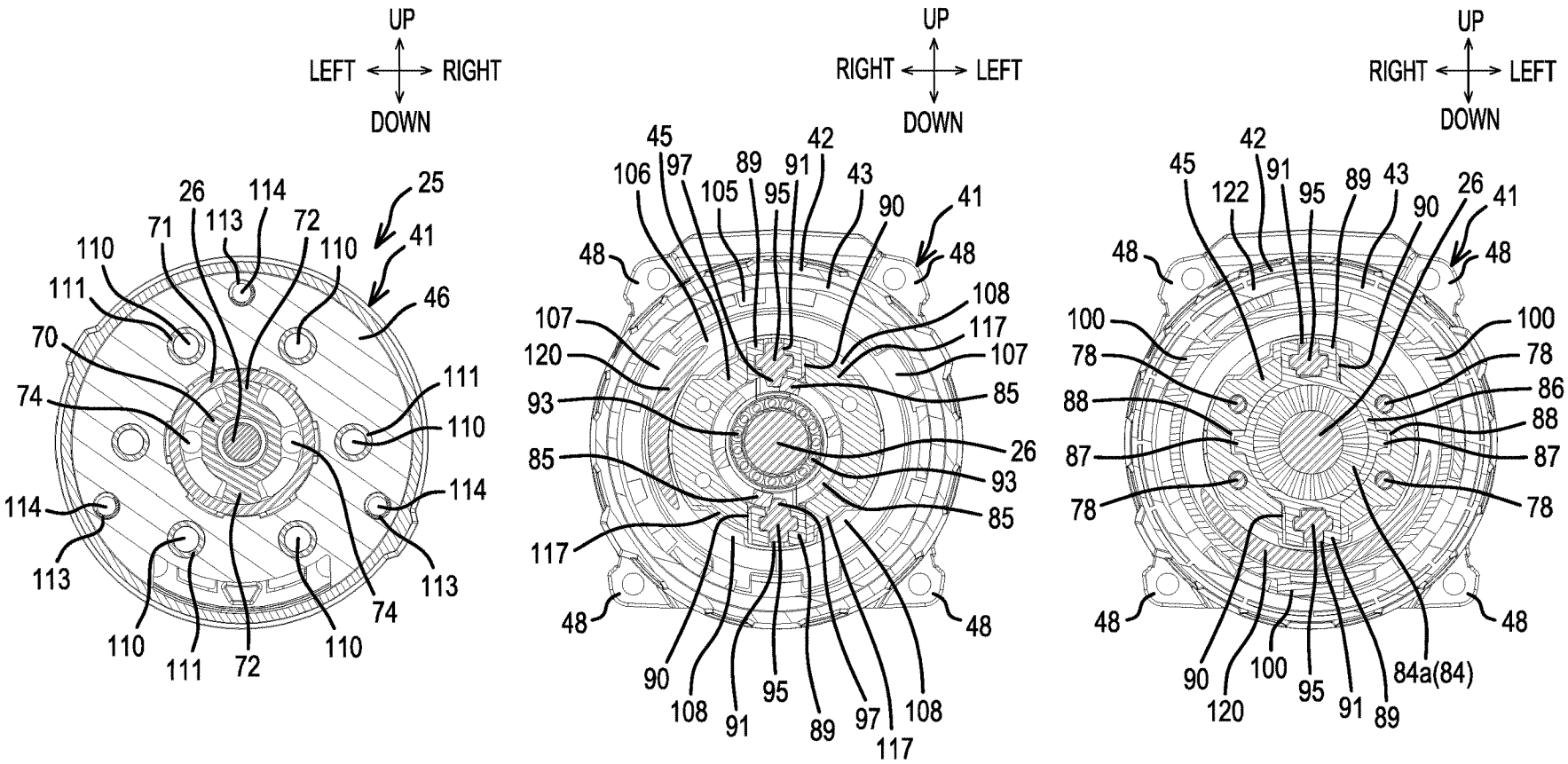
FIG. 10A is a cross-sectional view taken along line A-A in FIG. 9A.
FIG. 10B is a cross-sectional view taken along line B-B in FIG. 9A.
FIG. 10C is a cross-sectional view taken along line C-C in FIG. 9A.

Furthermore, a ring-shaped spacer 86 is provided inside the small-diameter portion 45 on the outer side of the first cam 83. As shown, e.g., in FIGS. 5C and 9A, the spacer 86 makes contact with the bearing 68, which is forward of the spacer 86, in the state in which rotation of the spacer 86 is locked, as shown in FIG. 10C, by virtue of ridges 87, provided on an outer circumference of the spacer 86, respectively engaging with recessed grooves 88, which are oriented (extend) in the axial direction from a front end and along an inner circumference of the small-diameter portion 45.

Figure 7B:
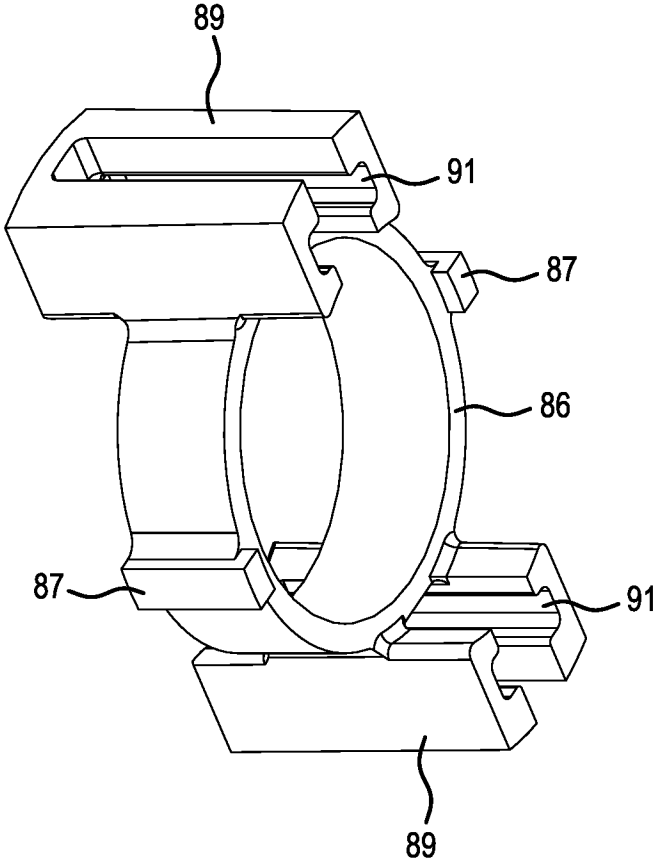
FIGS. 7A and 7B are front and rear oblique views, respectively, of a spacer of the hammer-driver drill.
Figure 7A:
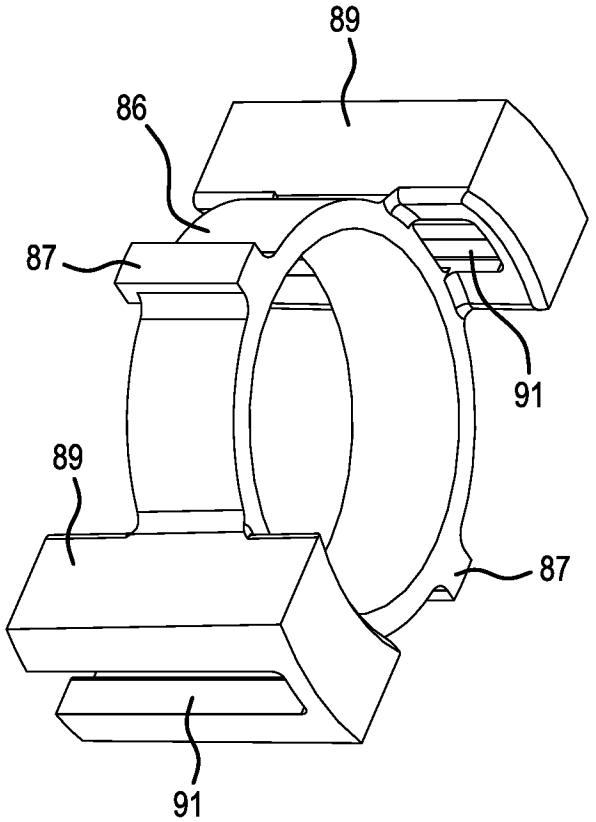
Figure 8A:
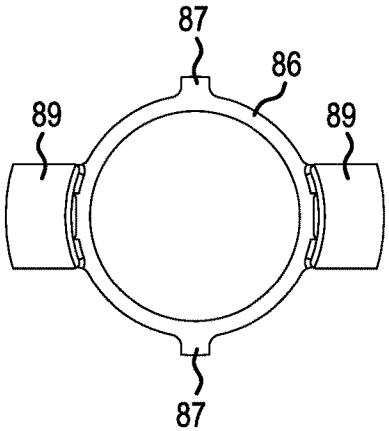
Figure 8B:
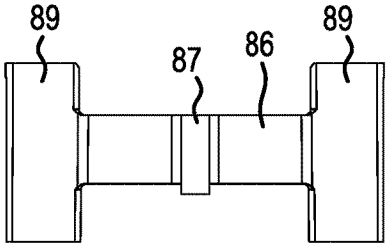
Figure 8C:
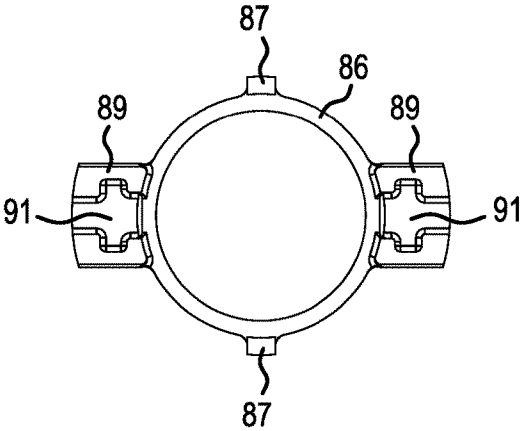
Figure 8D:
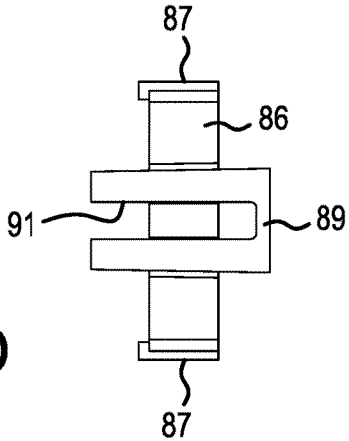

The spacer 86 is made of resin (polymer). As shown in FIGS. 7 and 8, two receiving members (linear plain bearings) 89, which are configured to respectively hold (support) two hammer-switching levers (switching members) 95 (described below) in a slidable manner, are integrally formed with the spacer 86 on the outer circumference of the spacer 86 at a phase that differs by 90° from the ridges 87. The two receiving members 89 respectively mate with (are fixedly fitted in) two slits 90, which are formed in the small-diameter portion 45 and extend rearward from a front end thereof, and fit within the small-diameter portion 45 when the spacer 86 is housed inside the small-diameter portion 45. Therefore, the front surfaces of the receiving members 89 are coplanar with the front end of the small-diameter portion 45. Guide grooves 91 are respectively defined on the interior surfaces of the receiving members 89. The guide grooves 91 each have a cross shape in a transverse cross-sectional view and are open at the rear surface and to the interior and exterior in the radial direction, as can be seen, e.g., in FIG. 8C.

Referring again to FIG. 6, a pair of (front and rear) ring washers 92 hold a plurality of steel balls 93 therebetween. The ring washers 92 are held by the small-diameter portion 45 between the second cam 84 and the bearing 69. The front-side ring washer 92 makes contact with the rear surface of the second cam 84 on the inner side of the meshing projections 85. When the front-side ring washer 92 makes contact with the spacer 86, the advance of the second cam 84 is restricted (blocked). Furthermore, in this state, the spindle 26 is spaced apart from the first cam 83, which is biased toward the advanced position.

Figure 9B:
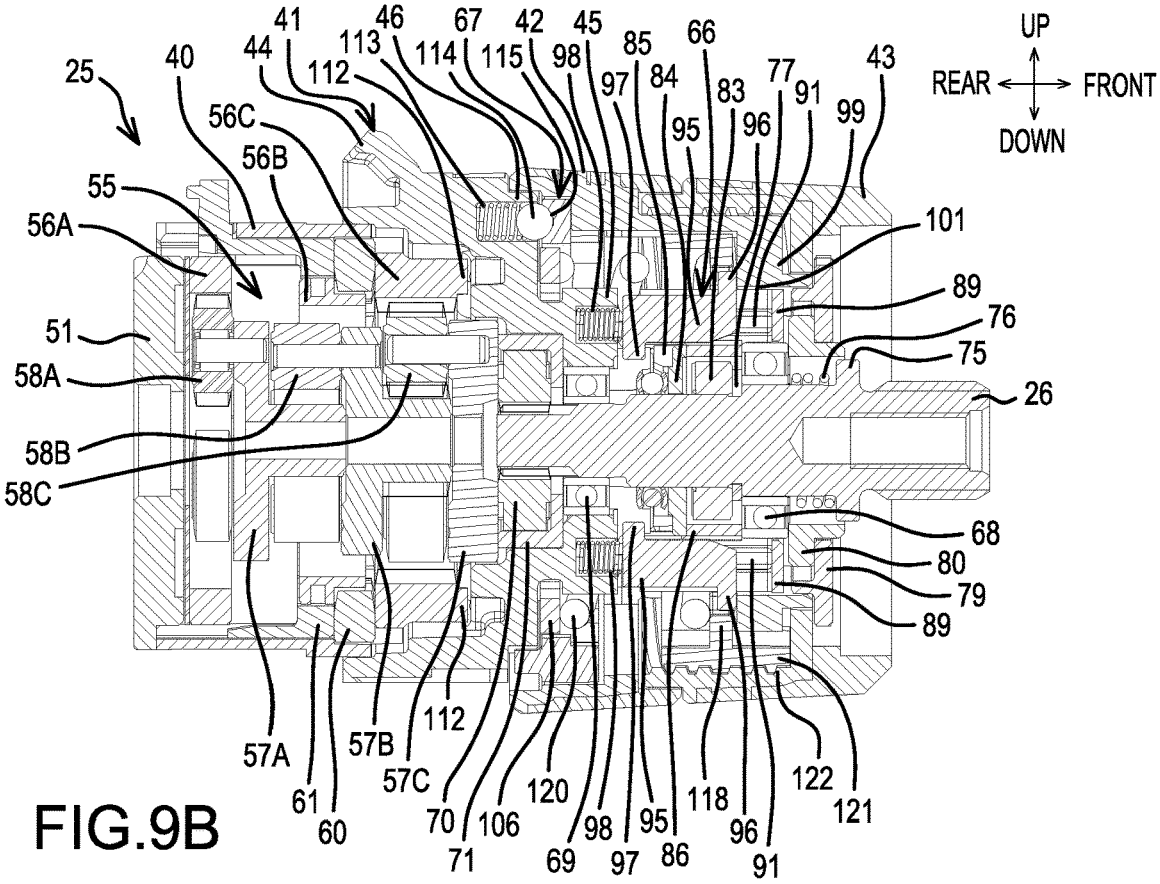

As was mentioned above, two hammer-switching levers (switching members) 95, which serve as hammer mode actuation/de-actuation devices, are respectively housed (held) in the receiving members 89 of the spacer 86, such that the hammer-switching levers 95 are each slidable in the front-rear direction relative to the spacer 86 and thus relative to the second case 41. As shown in FIGS. 10B and 10C, the hammer-switching levers 95 are bar- or rod-shaped bodies, which respectively mate with (slidably fit in) the guide grooves 91 of the receiving members 89 and whose transverse cross sections are cross shaped in the present embodiment. As shown in FIGS. 6, 9A and 9B, an outer-side projection (flange) 96, which protrudes radially outward from the respective guide groove 91, is provided on the radially outer side of the front end of each of the hammer-switching levers 95. Furthermore, an inner-side projection 97, which protrudes radially inward from the respective guide groove 91, is provided on the inner side of the rear end of each of the hammer-switching levers 95. The two inner-side projections 97 are located rearward of the second cam 84. Two coil springs 98, which differ in outer diameter, are respectively held by the inner surfaces of the rear ends of the slits 90 and respectively bias the two hammer-switching levers 95 forward.

In this embodiment, the hammer-switching levers 95 may be assembled with (inserted into) the spacer 86 by respectively placing the two coil springs 98 on the inner surfaces of the rear ends of the two slits 90 of the small-diameter part 45, and then inserting (mating) the spacer 86, in which the two hammer-switching levers 95 were previously inserted into the respective receiving members 89, from the front into the small-diameter portion 45 such that the ridges 87 are respectively phase-aligned (matched) with the recessed grooves 88 and the receiving members 89 are respectively phase-aligned (matched) with the slits 90, as can be seen in FIG. 10C. Thereby, the assembly of the receiving members 89 and the hammer-switching levers 95 is performed simultaneously with the mounting of the spacer 86 in the small-diameter portion 45.

Referring now to FIGS. 5B and 6, a cam ring 99 is disposed forward of the action-mode changing ring 42. The cam ring 99 fits in the interior of the clutch ring 43 and is coaxially coupled to the clutch ring 43 by three coupling parts 100, which are disposed around the circumferential direction of the cam ring 99 and are oriented (extend) in the front-rear direction. The outer-side projections 96 of the hammer-switching levers 95 make contact with a rear surface of the cam ring 99. A pair of trapezoidal notches 101, 101 (FIG. 6) is formed on the rear surface of the cam ring 99. As shown in FIG. 9A, at the rotational position of the action-mode changing ring 42 at which the notches 101 are located forward of the outer-side projections 96, the hammer-switching levers 95 are at the advanced position, at which the outer-side projections 96 mate with the notches 101, and position the inner-side projections 97 between the meshing projections 85 of the second cam 84. Thereby, the rotation of the second cam 84 is restricted (blocked).

In addition, as shown in FIGS. 6 and 9A, a retaining ring 105 mates, integrally rotatable with, a rear surface of the action-mode changing ring 42. A restricting ring 106 has outer projections 107 formed on an outer-circumference side thereof and inner projections 108 formed on an inner-circumference side thereof, both at prescribed spacings in the circumferential direction. The restricting ring 106 mates with an inner side of the retaining ring 105. By virtue of the outer projections 107 mating with inner grooves 109, which are provided in an inner circumference of the retaining ring 105, the restricting ring 106 is integrally rotatable with the retaining ring 105 and is movable in the axial direction.

As shown in FIGS. 6 and 10A, six engaging pins 110 are configured to move in the forward-rearward direction through respective sleeves 111, and are held, equispaced in the circumferential direction, by the disk part 46 rearward of the restricting ring 106. The six engaging pins 110 are engageable, in the circumferential direction, with respective cam projections 112 that protrude from the front surface of the third-stage internal gear 56C, in which the rear ends of the engaging pins 110 are rotatably provided. As shown also in FIGS. 3 and 9, steel balls 114, which are biased forward by respective coil springs 113, are provided at three locations on the disk part 46 concentric with the outer sides of the engaging pins 110. The steel balls 114 respectively mate with (in) hollow parts 115, which are provided in the rear surface of the retaining ring 105. Each of the three rotational positions at which the steel balls 114 mate with the hollow parts 115 causes a click action (detent function), thereby serving as the positions of each of the action modes.

A neck part 116 is formed on a base of the small-diameter portion 45. Axially-extending clearance grooves 117 are formed in an outer-circumferential surface of the small-diameter portion 45. The clearance grooves 117 communicate with the neck part 116 and open in the forward direction. A spring holder 118 is mounted around the small-diameter portion 45 and comprises engaging projections 119 that respectively engage with the clearance grooves 117. The spring holder 118 is movable in the axial direction in the state in which rotation is restricted (blocked). Rearward thereof, a clutch spring 120 is mounted between the spring holder 118 and the restricting ring 106. Screw (male-threaded) parts 121 are formed on an outer circumference of the spring holder 118 and are screwed into a female-thread part 122, which is provided on an inner circumference of the clutch ring 43. The axial length of the clutch spring 120 can be changed by rotating the clutch ring 43 to screw-feed it in the axial direction.

Next, each operation mode (action mode) that is selectable using the action-mode changing ring 42 will be explained.

First, as shown in FIGS. 9A and 10B, at rotational position A of the action-mode changing ring 42, the notches 101 are positioned forward of the outer-side projections 96 of the hammer-switching levers 95. Therefore, the two hammer-switching levers 95 respectively advance within (move forward relative to) the two receiving members 89 (owing to the biasing force of the coil springs 98), so that the inner-side projections 97 are respectively positioned between the meshing projections 85 of the second cam 84, thereby restricting (blocking) rotation of the second cam 84. As a result, when the first cam 83, which rotates together with the spindle 26, is retracted, the first cam 83 and the second cam 84 engage (interfere, interact) with one another at (via) the first and second cam surfaces 83*a*, 84*a*.

At rotational position A, the restricting ring 106 is restricted (blocked) from advancing by virtue of the inner projections 108 of the restricting ring 106 engaging with the neck part 116 of the small-diameter portion 45. In this state, because the advance of the engaging pins 110, which make contact with the front surface of the internal gear 56C, is restricted (blocked) and the engagement with the cam projections 112 is maintained, the hammer drilling mode results in which the rotation of the internal gear 56C is restricted (blocked).

At rotational position B, i.e. after the action-mode changing ring 42 has been rotated clockwise (as viewed from the front) away from rotational position A (the hammer drilling mode), the cam ring 99 has been rotated clockwise, which causes the notches 101 to move forward of the outer-side projections 96, whereby the outer-side projections 96 separate from the notches 101 and cause the hammer-switching levers 95 to retract (move (slide) rearward against the biasing force of the coil springs 98). As a result, as shown in FIG. 9B, because the inner-side projections 97 move rearward and are no longer positioned between the meshing projections 85 of the second cam 84, the restriction on the rotation of the second cam 84 is released.

At rotational position B, because the inner projections 108 of the restricting ring 106 are located rearward of the clearance grooves 117 of the small-diameter portion 45, the restricting ring 106 becomes movable in the forward-rearward direction. As a result, the screwdriving mode (rotation with clutch) results in which hammering is not generated and the rotation of the internal gear 56C is restricted (blocked) by virtue of the biasing force of the clutch spring 120 being transmitted to the internal gear 56C via the engaging pins 110. However, when a load that exceeds the biasing force of the clutch spring 120 is applied to the spindle 26, the cam projections 112 push the engaging pins 110 forward (out of engagement with the internal gear 56C), thereby idling the internal gear 56C and shutting off (interrupting, disengaging) the transmission of torque to the spindle 26. The set torque can be changed by the user by rotating the clutch ring (torque adjusting ring) 43 to screw-feed (move) the spring holder 118 in the axial direction, thereby changing the axial length of the clutch spring 120 and thus changing the load (torque) that must be applied to the spindle 26 to cause disengagement of the internal gear 56C. When the clutch ring 43 is rotated, click sensations occur owing to the fact that the leaf spring 82 sequentially elastically latches into the recesses 81 of the retaining plate 79.

At rotational position C, the action-mode changing ring 42 has been rotated clockwise (as viewed from the front) away from rotational position B (the screwdriving mode). At rotational position C, the hammer-switching levers 95 are retracted and the restriction on the rotation of the second cam 84 is released. Furthermore, the inner projections 108 of the restricting ring 106 move in the circumferential direction from the rear of the clearance grooves 117 and once again engage with the neck part 116, thereby restricting (blocking) the advance of the restricting ring 106. As a result, the drilling mode results in which hammering is not generated and the clutch mechanism 67 is not operational to disengage the transmission of torque to the spindle 26 owing to the fact that the engaging pins 110 make contact with the front surface of the internal gear 56C and the engaging pins 110 are restricted (blocked) from surmounting (riding over) the cam projections 112.

In the hammer driver-drill 1 configured as described above, when the switch 27 is turned ON by squeezing (pulling) the trigger 28, the microcontroller of the controller 33 acquires the rotational state of the rotor 11 by obtaining rotation-detection signals, which are output from the rotation-detection devices of the sensor circuit board 17, that indicate the positions of the permanent magnets 20 of the rotor 11, controls the ON/OFF state of the switching devices in accordance with the acquired rotational state, and rotates the rotor 11 by sequentially supplying electric current to the coil 14 of each phase of the stator 10. Therefore, because the rotary shaft 18 rotates and causes the spindle 26 to rotate via the speed-reducing mechanism 55, usage in the selected one of the operation (action) modes becomes possible with the bit (tool accessory) chucked (held, grasped) by the drill chuck 4.

Therefore, if the hammer drilling mode has been selected using the action-mode changing ring 42, then the hammer-switching levers 95 are at the advanced position, as discussed above, and the rotation of the second cam 84 is restricted (blocked). Consequently, axial hammering on the spindle 26 is generated while the spindle 26 is rotated by virtue of the teeth on the first cam surface 83*a* of the first cam 83, which rotates together with the spindle 26 that is pushed toward (against) the workpiece and retracted (moved rearward), interfering (mechanically interacting) with the teeth on the second cam surface 84*a* of second cam 84.

Thus, when hammering (repetitive axial impacts) is generated, vibration (caused by the hammering) also is transmitted to the hammer-switching levers 95. However, in this embodiment of the present teachings, the hammer-switching levers 95 are held by the small-diameter portion 45 via (in) the receiving members 89, which are made of resin (polymer). Therefore, owing to the fact that polymer materials have a greater elasticity than metals, the receiving members 89 act as a cushion that absorbs at least some of the vibration, such that the inner surfaces of the slits 90 of the small-diameter portion 45 tend to not wear or wear less.

On the other hand, if the screwdriving mode or the drilling mode is selected using the action-mode changing ring 42, then, because the hammer-switching levers 95 are at their retracted position such that the second cam 84 can rotate as described above, hammering is not generated even if the first cam 83, which rotates together with the spindle 26 that is pushed toward (against) the workpiece and retracted, makes contact with the (rotatable) second cam 84.

Thus, the hammer driver-drill 1 of the above-described embodiment, comprises, e.g., the second gear case 41 (case), which is made of metal; the spindle 26, which is axially supported inside the second gear case 41; the first cam 83, which is housed in the second gear case 41 and is fixed to the spindle 26 such that it is rotatable integrally therewith; the second cam 84, which is housed in the second gear case 41, provided on the spindle 26 such that it is rotatable separately therefrom, and provided such that it is capable of contacting (configured to be brought into contact with) the first cam 83; the hammer-switching levers 95 (switching members), which are provided such that they are moveable, relative to the second gear case 41, between the advanced position (first position), at which rotation of the second cam 84 is restricted (blocked), and the retracted position (second position), at which the rotation restriction on the second cam 84 is released; and the receiving members 89, which are interposed between the second gear case 41 and the hammer-switching levers 95. Therefore, in such an embodiment, even if the hammer-switching levers 95 vibrate (e.g., owing to the hammering impacts on the spindle 26 in the hammering mode), the direct impact on the second gear case 41 can be reduced owing to the cushioning (vibration absorbing) properties of the receiving members 89. Therefore, even if a second gear case 41 made of metal is used, wear on the second gear case 41 is reduced or even prevented, thereby improving durability.

In such an embodiment, it is noted that the slits 90, which indirectly house the hammer-switching levers 95 via the receiving members 89, are formed in the small-diameter portion 45 of the second gear case 41. In addition, the receiving members 89 mate with (fit in) the inside of the slits 90 and hold the hammer-switching levers 95 so that the hammer-switching levers 95 are movable (slidable) relative to the receiving members 89 and thus relative to the slits 90. Therefore, even if the receiving members 89, which are separate bodies, are used, they can compactly fit in the second gear case 41. In addition, replacement of the receiving members 89 also can be performed in a simple manner.

In addition, because a plurality of the hammer-switching levers 95 is provided and because the receiving members 89, which respectively receive (slidably hold) the hammer-switching levers 95, are integrally coupled to one another (via the spacer 86), even though there are multiple receiving members 89, they can be manufactured integrally, and their assembly into the small-diameter portion 45 can also be performed easily.

Furthermore, because the receiving members 89 are made of resin (polymer), they can be manufactured easily, and advantageous cushioning characteristics are also obtained.

It is noted that the receiving members of the above-described embodiment may be modified such that the number, shape, and the like of the receiving members is not limited to the above-mentioned embodiment and can be appropriately changed in accordance with the number, shape, and the like of the hammer-switching levers. In addition, in the above-described embodiment, the manufacture, assembly, and the like are made easy by the integration (integral formation) of the receiving members with the spacer; however, the receiving members may be formed separately from the spacer and assembled individually, and the receiving members alone may be coupled to one another without the use of a spacer.

Furthermore, the receiving members are not limited to being made of resin (polymer), and may be made of a metal, such as iron, a composite of metal and resin, or the like. Preferably, at least some cushioning (vibration absorbing) characteristics are provided by the receiving members.

In addition, it is noted that the hammer driver-drill 1 of the above-mentioned embodiment, comprises, e.g., the second gear case 41 (case) made of metal; the spindle 26, which is axially supported inside the second gear case 41; the first cam 83, which is housed in the second gear case 41 and is fixed to the spindle 26 such that it is rotatable integrally therewith; the second cam 84, which is housed in the second gear case 41, provided on the spindle 26 such that it is rotatable separately therefrom, and provided such that it is capable of contacting the first cam 83; the hammer-switching levers 95 (switching members), which are provided such that they are moveable, relative to the second gear case 41, between the advanced position (first position), at which rotation of the second cam 84 is restricted (blocked), and the retracted position (second position), at which the rotation restriction on the second cam 84 is released; and the receiving members 89 (resin/polymer members), which are interposed between the second gear case 41 and the hammer-switching levers 95. Therefore, even if the hammer-switching levers 95 vibrate, the direct impact on the second gear case 41 can be reduced. Thereby, even if the second gear case 41 made of metal is used, wear on the second gear case 41 is reduced or even prevented, thereby improving durability.

In this embodiment, it is noted that the receiving members 89 are fixed to the inner side of the second gear case 41 side guide the (sliding) movement of the hammer-switching levers 95. The receiving members 89 are preferably designed to be capable of guiding (are configured to guide) the hammer-switching levers 95 with any suitable shape that conforms (is complementary) to the transverse cross-section of the hammer-switching levers 95. Furthermore, in alternate embodiments of the present teachings, the receiving members 89 may be respectively fixed (attached) to the switching members 95 so that the receiving members 89 move (slide) integrally with the switching members 95 relative to the case 41. In other words, the receiving members 89 may be designed to be slidable relative to the case 41 together with the switching members 95.

It is noted that the resin/polymer members disposed between the case and the switching members may be modified. For example, the shape of the receiving members can of course be changed. In addition or in the alternative, as long as the receiving members are separate from the case in the above-mentioned embodiment, the resin members may be formed integrally with the inner surfaces of the slits of the small-diameter portion. In the alternative, the resin members may be formed integrally with the outer surfaces of the hammer-switching levers. In another modification, the resin members may be formed integrally with the inner surfaces of the slits and the outer surfaces of the hammer-switching levers.

Furthermore, each cam of the hammer mechanism is not limited to being entirely housed within the case and may be partially housed within the case in further modifications of the above-described embodiment.

In addition, the present teachings are not limited to hammer driver-drills. That is, the present teachings also are applicable to other types of power tools having a hammer mechanism, such as a hammer drill that is switchable between a hammering mode and a drilling mode, as long as a hammer mechanism is provided and it is possible to switch the operation thereof ON and OFF. The motor also may be modified to be, e.g., a commutator motor, or the like, instead of a brushless motor. Furthermore, power tools according to the present teachings may be designed as an AC tool that is powered by a commercial AC power supply via a power cord instead of by a battery pack.

Herein, the terms "resin" or "resin member" were used to describe the material of some of the structures of the hammer driver-drill 1. However, it is to be understood that these terms are meant to encompass or be synonymous with terms such as "polymer", "synthetic material", etc. In practice, the various "resin" parts or members may be made of a synthetic polymer that may comprise one or more organic molecules, such as polyamide (PA), polypropylene (PP), polyethylene (PE), polybutylene (PB-1), polytetrafluoroethylene (PTFE), polyether ether ketone (PEEK), polyoxymethylene (POM), polyimide (PI), etc. Such polymer materials may be fiber-reinforced, e.g., with glass fibers, carbon fibers, basalt fibers, etc. and may comprise additional additives to adjust the properties of the polymer material in accordance with the particular application.

Furthermore, although the terms "hammer-switching lever" or "switching member" were used to describe element 95 in the Figures, it is noted that alternate terms may be used, such as "hammer-actuation bar", "hammer-actuation rod", etc. All of these terms are intended to encompass an elongated element having a body portion, along which its transverse cross-section is constant or at least substantially constant over all or most of the longitudinal extension of the elongated element. The primary function of the switching (actuation) member(s) 95 is to switch on or actuate the hammer mode and to switch off or de-actuate the hammer mode. In the preferred embodiments, it performs this function, in part, by sliding along its axial or longitudinal (length) extension direction relative to the receiving element (s) 89. Thus, to facilitate such longitudinal sliding movement, it is best that any portion(s) of element 95 that contact(s) and slide(s) along complementary surface(s) of the receiving member 89 have a constant transverse cross-section along the longitudinal extension direction. Although a cross shape was utilized in the preferred embodiment, other polygonal shapes may be utilized, including various types of prism shapes. Moreover, the element may include a curved surface in the traverse cross-section, such that the transverse cross-section may be circular, oval, semi-circular, wedge-shaped, etc. Thus, in its most basic form, the switching (actuation) member 95 is configured to slide along its longitudinal extension direction from a first axial position to a second axial position, and vice versa, whereby actuation and de-actuation of the hammer mechanism respectively take place at the first and second axial positions. The switching member(s) 95 may be made of a metal or a rigid polymer so that bending along the longitudinal length extension is minimized or prevented.

Additional aspects of the present teachings include, but are not limited to:

1. A power tool (1) having a hammer mechanism comprising:

a case (41) made of metal;

a spindle (26) axially supported inside the case;

a first cam (83), at least a portion of which is housed in the case (41) and which is fixed to the spindle (26) such that it is rotatable integrally therewith;

a second cam (84), at least a portion of which is housed in the case (41), is rotatable separately with respect to the spindle and is provided such that it is capable of contacting the first cam (83);

a switching member (95), which is provided such that it is moveable, relative to the case (41), between a first position, at which rotation of the second cam (84) is restricted, and a second position, at which the rotational restriction on the second cam (84) is released; and a receiving member (89) interposed between the case (41) and the switching member (95).

2. The power tool (1) according to the above Aspect 1, wherein:

a slit (90) is defined in the case (41), and the receiving member (89) mates with the interior of the slit (90) and holds the switching member (95) such that the switching member (95) is movable relative to the receiving member (89).

3. The power tool (1) according to the above Aspect 1 or 2, wherein:

a plurality of the switching members (95) is provided, a corresponding number of the receiving members (89) are provided such that the receiving members (89) respectively hold the switching members (95) such that the switching members (95) are respectively movable relative to the receiving members (89), and the receiving members (89) are integrally coupled to one another.

4. The power tool (1) according to any one of the above Aspects 1-3, wherein the receiving member(s) (89) is (are) made of resin (polymer).

5. A power tool (1) having a hammer mechanism comprising:

a case (41) made of metal;

a spindle (26) axially supported inside the case (41);

a first cam (83), at least a portion of which is housed in the case (41) and which is fixed to the spindle (26) such that it is rotatable integrally therewith;

a second cam (84), at least a portion of which is housed in the case (41) and which is provided on the spindle (26) such that it is rotatable separately therefrom and is provided such that it is capable of contacting the first cam;

a switching member (95), which is provided such that it is moveable, relative to the case (41), between a first position, at which rotation of the second cam (84) is restricted, and a second position, at which the rotational restriction on the second cam (84) is released; and a resin (polymer) member (89) interposed between the case (41) and the switching member (95).

6. The power tool (1) according to the above Aspect 5, wherein the resin member (89) is fixed to an inner side of the case (41) and guides movement of the switching member (95) relative to the case (41).

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved power tools, such as but not limited to hammer driver-drills and hammer drills.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXPLANATION OF THE REFERENCE NUMBERS

1 Hammer driver-drill
2 Main body
3 Handle
4 Drill chuck
5 Battery pack
6 Main-body housing
9 Brushless motor
18 Rotary shaft
25 Gear assembly
26 Spindle
40 First gear case
41 Second gear case
42 Action-mode changing ring
43 Clutch ring
44 Large-diameter portion
45 Small-diameter portion

55 Speed-reducing mechanism
66 Hammer mechanism
67 Clutch mechanism
83 First cam
84 Second cam
85 Meshing projection
86 Spacer
89 Receiving member
90 Slit
91 Guide groove
95 Hammer-switching lever
96 Outer-side projection
97 Inner-side projection
99 Cam ring
101 Notch

The invention claimed is:

1. A power tool comprising:
a case made of metal;
a spindle axially supported inside the case; and
a hammer mechanism including:
a first cam, at least a portion of which is housed in the case and which is fixed to the spindle such that it is rotatable integrally therewith;
a second cam, at least a portion of which is housed in the case, is rotatable separately with respect to the spindle and is provided such that it is capable of contacting the first cam;
a switching member, which is provided such that it is movable, relative to the case, between a first position, at which rotation of the second cam is restricted, and a second position, at which the rotational restriction on the second cam is released; and
a receiving member interposed between the case and the switching member and fixed relative to the case,
wherein:
the case includes a first slit configured to axially receive the receiving member, the first slit being defined by a first surface of the case and a second surface of the case, the second surface of the case being spaced circumferentially from the first surface of the case,
the receiving member includes a second slit, the second slit being defined by a first surface of the receiving member and a second surface of the receiving member,
the receiving member is mounted in the first slit between the first surface of the case and the second surface of the case, and
the switching member is slidably mounted in the second slit between the first surface of the receiving member and the second surface of the receiving member for linear movement relative to the receiving member.

2. The power tool according to claim 1, wherein:
the receiving member mates with the interior of the first slit.

3. The power tool according to claim 1, wherein:
a plurality of the switching members is provided;
a corresponding number of the receiving members are provided such that the receiving members respectively hold the switching members such that the switching members are respectively movable relative to the receiving members; and
the receiving members are integrally coupled to one another.

4. The power tool according to claim 1, wherein the receiving member is made of a polymer material.

5. The power tool according to claim 4, wherein:
a plurality of the switching members is provided;
a corresponding number of the receiving members made of the polymer material are provided such that the receiving members to respectively hold the switching members to permit the switching members respectively move relative to the receiving members; and
the receiving members are integrally coupled to one another.

6. The power tool according to claim 5, wherein:
a corresponding number of first slits are defined in the case; and
the receiving members respectively fit in the first slits and respectively hold the switching members.

7. A power tool comprising:
a case made of metal;
a spindle axially supported inside the case; and
a hammer mechanism including:
a first cam, at least a portion of which is housed in the case and which is fixed to the spindle such that it is rotatable integrally therewith;
a second cam, at least a portion of which is housed in the case, is rotatable separately with respect to the spindle and is provided such that it is capable of contacting the first cam;
a switching member, which is provided such that it is movable, relative to the case, between a first position, at which rotation of the second cam is restricted, and a second position, at which the rotational restriction on the second cam is released; and
a polymer member interposed between the case and the switching member and fixed relative to the case,
wherein:
the case includes a first slit configured to axially receive the polymer member, the first slit being defined by a first surface of the case and a second surface of the case, the second surface of the case being spaced circumferentially from the first surface of the case;
the polymer member includes a second slit, the second slit being defined by a first surface of the polymer member and a second surface of the polymer member;
the polymer member is mounted in the first slit between the first surface of the case and the second surface of the case; and
the switching member is slidably mounted in the second slit between the first surface of the polymer member and the second surface of the polymer member for linear movement relative to the polymer member.

8. The power tool according to claim 7, wherein the polymer member is fixed to an inner side of the case.

9. A power tool comprising:
a metal case;
a spindle rotatably supported inside the metal case; and
a hammer mechanism including a first cam, a second cam, a first hammer-actuation device and a first linear plain bearing slidably supporting the first hammer-actuation device;
wherein:
the first cam is affixed to the spindle so as to rotate therewith;
at least a portion of the first cam and at least a portion of the second cam are housed within the metal case;
the second cam is disposed around the spindle and is axially movable to bring teeth of the second cam into and out of contact with teeth of the first cam;
the first hammer-actuation device is movable in parallel to a rotational axis of the spindle from a first axial position relative to the spindle to a second axial position relative to the spindle, and vice versa;

in the first axial position, rotation of the second cam relative to the metal case is blocked;

in the second axial position, rotation of the second cam relative to the metal case is not blocked;

the first linear plain bearing is fixed relative to the metal case and is more elastic than the metal case;

the case includes a first slit configured to axially receive the first linear plain bearing, the first slit being defined by a first surface of the case and a second surface of the case, the second surface of the case being spaced circumferentially from the first surface of the case;

the first linear plain bearing includes a second slit, the second slit being defined by a first surface of the first linear plain bearing and a second surface of the first linear plain bearing;

the first linear plain bearing is mounted in the first slit between the first surface of the case and the second surface of the case; and the hammer-actuation device is slidably mounted in the second slit between the first surface of the first linear plain bearing and the second surface of the first linear plain bearing for linear movement relative to the first linear plain bearing.

10. The power tool according to claim 9, further comprising:

a second hammer-actuation device; and a second linear plain bearing fitted in a second first slit defined in the metal case;

wherein:

the second linear plain bearing slidably supports the second hammer-actuation device; and the first linear plain bearing is integrally connected to the second linear plain bearing.

11. The power tool according to claim 10, wherein the first and second linear plain bearings are formed of a polymer material and are formed integrally with a spacer.

12. The power tool according to claim 11, wherein the first and second hammer-actuation devices each have a non-circular transverse cross-section along a longitudinal body portion thereof.

13. The power tool according to claim 12, wherein the first and second linear plain bearings are configured to prevent rotation of the first and second hammer-actuation devices about the longitudinal body portions.

14. The power tool according to claim 13, wherein:

the first and second linear plain bearings are integrally formed on diametrically opposite sides of an annular spacer that is formed of the same polymer material; and the spindle extends through the annular spacer.

15. The power tool according to claim 14, wherein at least the first cam is disposed within the annular spacer.

16. The power tool according to claim 15, wherein:

the second cam has a plurality of meshing projections extending in parallel to the rotational axis of the spindle; and the first and second hammer-actuation devices each have a projection that extends perpendicular to the rotational axis of the spindle, the projections being configured to mesh with the meshing projections to block rotation of the second cam when the first and second hammer-actuation devices are disposed in the first axial position.

17. The power tool according to claim 16, further comprising:

first and second springs respectively biasing the first and second hammer-actuation devices in a direction parallel to the rotational axis of the spindle; and a manually-operable adjusting ring disposed on an external surface of the power tool and being rotatable relative to the metal case;

wherein rotation of the manually-operable adjusting ring about the rotational axis of the spindle causes the first and second hammer-actuation devices to move between the first and second axial positions.

18. The power tool according to claim 9, wherein the first linear plain bearing is composed of a polymer material.

19. The power tool according to claim 18, wherein the first hammer-actuation device has a non-circular transverse cross-section along a longitudinal body portion thereof.

* * * * *